114-253
11/25/80 XR 4,235,182 SR

United States Patent [19]
Bürger

[11] 4,235,182
[45] Nov. 25, 1980

[54] TRACTION ARRANGEMENT FOR USE BY A SAIL SURFER OR WATER SKIER

[76] Inventor: Reinhard Bürger, Karlsbader Str. 19, 6100 Darmstadt, Fed. Rep. of Germany

[21] Appl. No.: 908,915

[22] Filed: May 24, 1978

[30] Foreign Application Priority Data

| | | | |
|---|---|---|---|
| May 25, 1977 | [DE] | Fed. Rep. of Germany | 2723541 |
| Jun. 29, 1977 | [DE] | Fed. Rep. of Germany | 2729228 |
| Dec. 23, 1977 | [DE] | Fed. Rep. of Germany | 2757545 |
| Feb. 6, 1978 | [DE] | Fed. Rep. of Germany | 2805000 |

[51] Int. Cl.[3] ..... A63C 11/10; B63H 21/56
[52] U.S. Cl. ..... 440/34; 9/310 A; 114/39; 114/253
[58] Field of Search ..... 2/20, 161 A; 182/3-9; 224/254, 260, 159, 157, 269; 294/25; 244/16; 9/310 A, 310 R; 115/6.1; 114/242, 253, 254, 39

[56] References Cited

U.S. PATENT DOCUMENTS

| | | | |
|---|---|---|---|
| 1,185,698 | 6/1916 | Miller | 224/260 |
| 1,240,728 | 9/1917 | Jordan | 2/20 |
| 1,279,073 | 9/1918 | Baake | 224/268 |
| 1,574,927 | 3/1926 | Otto | 294/25 |
| 1,836,223 | 12/1931 | Burns | 294/25 |
| 3,494,319 | 2/1970 | Dunlap | 115/6.1 |
| 3,541,990 | 11/1970 | Dumas | 115/6.1 |
| 3,707,730 | 1/1973 | Slider | 2/161 A |
| 4,043,290 | 8/1977 | Holland | 115/6.1 |
| 4,051,553 | 10/1977 | Howard | 2/161 A |
| 4,112,865 | 9/1978 | Carn | 114/39 |

*Primary Examiner*—Trygve M. Blix
*Assistant Examiner*—D. W. Keen
*Attorney, Agent, or Firm*—Michael J. Striker

[57] ABSTRACT

A traction arrangement for use by a sail surfer or water skier who is pulled along by holding onto a bar-shaped member connected to pulling apparatus, has two pulling elements which are arranged to be worn by a user and each having a leading end, and two connecting elements for detachably connecting the pulling elements to the bar-shaped member. Each of the connecting elements is provided at the leading end of a respective one of the pulling elements and is flexible so as to be deformable about the bar-shaped member by a pressure of the user's hands to thereby engage the bar-shaped member in frictional connection with the latter. In the event of a fall or when the user wishes to disengage the bar-shaped member, cessation of pressure by the user's hands suffices to terminate the frictional connection. The connecting elements may be formed by inner portions of gloves which are connected to the pulling elements. A method of manufacturing such gloves includes the steps of providing a glove reinforcing element having a surface which corresponds to an inner surface of the user's hand, positioning an immersion mold which has portions corresponding to glove fingers, on this surface of the reinforcing element, and immersing the mold in a glove-forming material so as to form the glove as the coating of the mold.

39 Claims, 9 Drawing Figures

TRACTION ARRANGEMENT FOR USE BY A SAIL SURFER OR WATER SKIER

BACKGROUND OF THE INVENTION

The present invention relates to a traction arrangement for use by a sail surfer or water skier.

Traction arrangements for the above-mentioned use have been known in the art. Such a traction arrangement includes two pulling elements which extend from the user's back to and are detachably connected with a bar-shaped member. When the traction arrangement is used with water skis, the bar-shaped member is connected with a motor boat. The known arrangements for sail surfers is formed as a trapeze of a boat sail and includes hooks or clamps which detachably connect a harness arranged to be worn by a user with the bar-shaped member. Such a traction arrangment is disclosed in the magazine "Surf, Magazin Für Segelsurfer", 1977, issue 3, pp. 28–30. These traction arrangements possess various disadvantages. They can be connected with the bar-shaped member only after sailing. Their handling is not very good and their mounting can cause damage or injury. In the known arrangements which can be disconnected from the bar-shaped member only by pulling down the latter, there is a danger that the sail surfer in the case of a crash will fall on the sail.

In the known traction arrangements, an integral and longitudinally adjustable belt is connected by its one end to a mast of the sail surfboard and extends through a shoulder, a back, and under a shoulder of the user to a mounting element which is fixedly connected to the bar-shaped member. Here, the belt end is so connected that it can be disconnected by release of a handle. During sailing and turning the handling of this belt is relatively difficult inasmuch as the belt connected to the mast embraces the user's back and must be mounted on the mounting element of the mast. Since the engagement of the belt with the bar-shaped member is fixed by the mounting element, therefore the movability and controllability is substantially limited.

When the traction arrangement is utilized by a water skier, it also has disadvantages. The arrangement which is positively connected with a boat, even if it is relatively quickly releasable, cannot be sufficiently quickly disconnected from the boat and therefore the rope of the arrangement after a water skier's fall moves through the water with a high force and speed that exposes the water skier to an extraordinary danger and can cause injuries.

SUMMARY OF THE INVENTION

Accordingly, it is an object of the present invention to provide a traction arrangement for use by a sail surfer or waterskier, which avoids the disadvantages of the prior art.

More particularly, it is an object of the present invention to provide a traction arrangement which can be simply and securely connected with a bar-shaped member and can be disconnected from the latter in a simple manner, and the considerably great liberty of movement of the user is maintained.

Still another feature of the present invention is to provide a traction arrangement which can be secured to the bar-shaped member before the sailing so that, the user can be easily released during abrupt and unexpected falls.

A further object of the present invention is to provide a traction arrangement which is easy to handle especially during sailing and turning and which eliminates a possibility of damages or injuries.

In keeping with these objects, and with others which will become apparent hereinafter, one feature of the present invention resides, briefly stated, in a traction arrangement which has two pulling elements arranged to be worn by a user and each having a leading end, and means for detachably connecting the pulling elements to a bar-shaped member held by a user, which means includes two connecting elements each provided at the leading end of the respective one of the pulling elements and being flexible so as to be deformable about the bar-shaped member by a pressure of the user's hand to thereby engage the bar-shaped member in frictional connection with the latter.

In such a construction the connecting elements are positioned at respective locations of the bar-shaped member and detachably connected therewith. A small pressure of the user's hands when the user holds the bar-shaped member, suffices to attain such high friction that the pulling elements transmit the required force to the bar-shaped member and thereby the user's hands are unloaded. A small pressure which is applied by the user's hands and increases the above-mentioned friction, suffices to maintain the required frictional connection after loading of the pulling elements. The pulling elements are first loose and become tensioned when the arms are stretched.

Another feature of the present invention is that the connecting elements are provided with means for fixing the same to the user's hands so that the connecting elements are maintained in their location below the user's hands when the user is released from the bar-shaped member. Preferably, the fixing means is formed as a loop-shaped member arranged on the upper surface of the connecting element, or as a glove. In order to adjust the angle included between the direction of the pulling elements and the longitudinal direction of the hands the fixing means may be mounted turnably about an axis which is approximately normal to the face of the connecting element.

Still another feature of the present invention is that, in order to provide for a possibility to transmit a relatively high force with a small pressure applied by the user's hand, an inner surface of the connecting elements which faces toward the bar-shaped member is provided with means having a high coefficient of friction with the bar-shaped member. This means may include a coating having a high coefficient of friction.

In accordance with a further feature of the present invention, in order to retard the action of gusts, the pulling elements and/or the connecting elements are provided for spring elements which are resilient in the pulling direction. The connecting elements and/or the pulling elements also can be constituted by a resilient material.

In accordance with an especially advantageous feature of the present invention, the pulling elements are of one piece with one another and together form an integral pulling element. This makes simpler the positioning of the pulling elements on the user's back or on the harness. Preferably, the integral pulling element is movable so as to assure especially great liberty of movement of the user.

It is advantageous when the integral pulling element is longitudinally movable in the region of the user's back within guiding means of the harness. The harness has a further flat element located in the region of the user's back, and the guiding element is preferably mounted on the above-mentioned further element approximately in the central region of the user's back. In such a construction, the pulling element is adequately arranged on the user's back, on the one side, and the user has full liberty of movement, on the other hand, independently of the direction of the pulling element. This results in that the user can place the pulling element at each location of the bar-shaped member inasmuch as it is sufficient to place the connecting elements to respective locations of the bar-shaped member. Special mounting elements and the like on the bar-shaped member are not needed.

In accordance with yet one advantageous feature of the present invention, the integral pulling element is formed as a rope which extends through an inner passage of the tubular guiding element, which latter is turnably mounted in the harness in the central region of the user's back. The pulling element and/or the parts of the harness which are in contact with the guiding element, and the guiding element itself may be constituted by a material having high sliding characteristics so as to facilitate the relative movement of the above-mentioned elements. Preferably, the pulling element is adjustable in the longitudinal direction thereof so as to assure good adaptation to the dimensions of the user's body and to the wind intensity.

In accordance with an additional advantageous feature of the present invention, the connecting element is formed as an inner portion of a glove, which glove has a reinforcing member connected with the pulling element. This facilitates the handling of the traction arrangement inasmuch as the user reliably and correctly engages the bar-shaped element also in the case of fast gripping variations, without paying attention to positioning of the connecting elements.

Since the connecting elements form a part of the glove, particularly the inner portion of the latter, the connecting element always is located in a correct position when the user inserts his or her hands into the glove. The application of the relatively high pulling force in the connecting element is guaranteed by the fact that the reinforcing element located inside the glove is connected with the pulling element. Therefore, the glove itself can be constituted by an especially suitable material, for instance by a rubber elastic material. The reinforcing member can be constituted by a texture of high-strength synthetic plastic fibers. Thus, the reinforcing element is constituted by a material having especially high strength, whereas the glove can be manufactured from a material which does not necessarily have this characteristic. The gloves can be constituted by a material which is sufficiently elastic and has the highest possible coefficient of friction with the material of the bar-shaped member.

Preferably, a strip-shaped projecting portion of the reinforcing members extend to the glove fingers which substantially embrace the bar-shaped member so as to transmit a given force of the pulling element.

The application of the force of the pulling element to the reinforcing member of the gloves takes place in such a manner that the reinforcing member is connected with the mounting ear by the end portion of the reinforcing element projecting out of the glove. The mounting ear is, in turn, connected with the end of the pulling element. The ear has a mounting opening whose inner edge engaging the pulling element is curved and described from a center which is located in the region of the bar-shaped member engaged by the gloves. This guarantees that different gripping forces resulting from the holding position of the user are always directed to the connecting point. Therefore, the gloves, despite different directions of the gripping force, maintain their normal position, without folding of the reinforcing members. The pulling element which is provided, for instance, with a hook engageable in the mounting ear, moves under the action of the gripping force relative to the gloves.

An additional particularly advantageous feature of the present invention is that the fingers of the gloves in non-deformed position are curved so that in the normal position of the gloves when the latter engages the bar-shaped element, no folds are formed, and the pulling force is transmitted from the entire contact surface to the pulling element.

In accordance with yet an additional feature of the present invention, the traction arrangement for use by a water skier whose is pulled by a boat has a bar connectable to the boat by a rope and arranged to be held by the user's hand, two pulling elements extending from the user's body toward the bar and each having a leading end, and two connecting members each provided at the leading end of a respective one of the pulling members and being flexible so as to be deformable about the bar by pressure of the user's hand to thereby engage the bar-shaped member in frictional connection with the latter. The bar connectable to the boat is round and held transverse in front of the user's breast. In the end regions or in the central region of the bar it can be connected by the safety rope to the boat. Since the connecting members assures easy and fast disconnection of the pulling elements from the bar, thereby, the danger of insufficiently fast disconnection is eliminated and, at the same time, the arms and hands of the water skier are unloaded.

In accordance with a still additional feature of the present invention, a method of manufacturing a glove arranged on a holding bar of the present arrangement is provided, which method includes the steps of providing a glove reinforcing element having a surface which corresponds to an inner surface of the user's hand, positioning an immersion mold which has portions corresponding to the glove fingers, on this surface of the reinforcing element, and immersing said mold in a glove forming material so as to form the glove as a coating of the mold. A connecting ear may be formed on the reinforcing member by an injection molding process, prior to the positioning step. The reinforcing member may be constituted of a high-strength synthetic fiber material, whereas the glove forming material in which the mold is immersed may be a fluid, emulsified, or dissolved material. The glove forming material may be constituted by rubber. The tips of the thus-formed gloves may be cut off.

The novel features of the present invention which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

DESCRIPTION OF THE PREFERRED EMBODIMENTS

Figure 1:
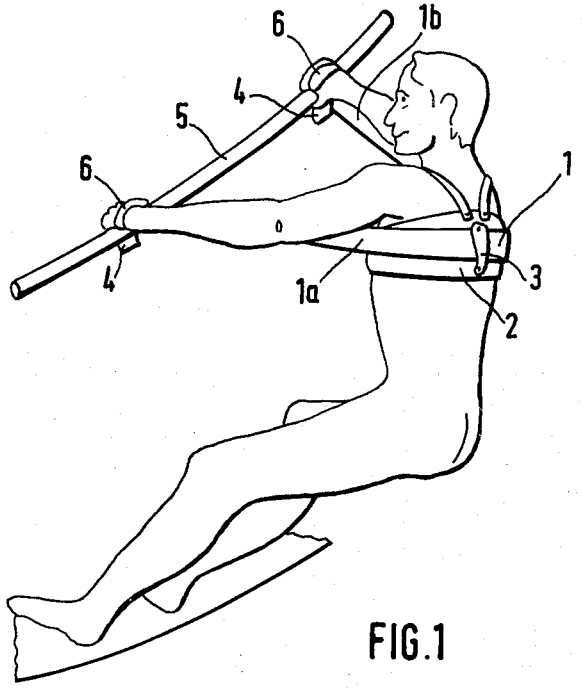
FIG. 1 is a view showing a traction arrangement in accordance with the present invention, which includes elements surrounding the user's back and connectable with a bar-shaped member of a sail surfboard.

As shown in FIG. 1, a traction arrangement in accordance with the present invention includes two beltlike pulling elements 1*a* and 1*b* which together form an integral pulling element 1 extending behind the back of the sail surfer. The sail surfer or the user wears a harness 2 located on the user's back. The pulling element 1 extends through the loop 3 of the harness 2. The both portions 1*a* and 1*b* of the pulling element 1 extends to the user's hands and are provided at their ends with a flexible substantially flat connecting element 4. The connecting element 4 can be deformed by the user's hand about a bar-shaped member 5 connected to not shown pulling means. A loop 6 is arranged at the upper side of each of the connecting elements 4, through which loops 6 the user's hands can pass.

As shown in FIG. 1, the user's arms pass further through the loop 6. The greater part of the force which acts between the user's back and the bar-shaped member 5 is transmitted through the pulling element 1. The user exerts by his or her hands only such a force which guarantees application of a sufficient pressure to the connecting elements 4 so as to deform the latter for embracing the bar-shaped member 5.

When the user releases the bar-shaped member, for example as a result of a fall, the pressing force applied to the connecting elements 4 disappears and the traction arrangement becomes disengaged from the bar-shaped member 5. In this case, special steps of releasing hooks or the like elements are not needed.

Figure 2:
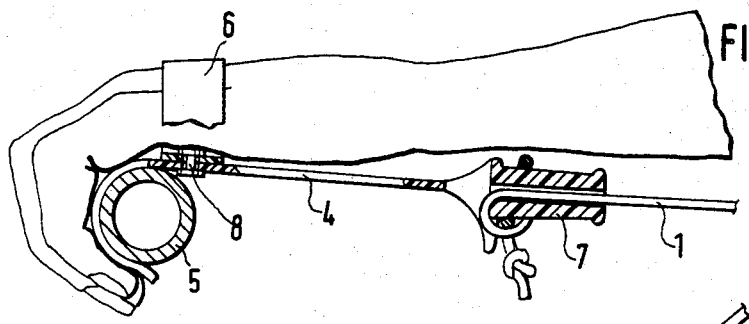
FIG. 2 is an enlarged side view of the sail surfer's hand which embraces the bar-shaped member.
Figure 3:
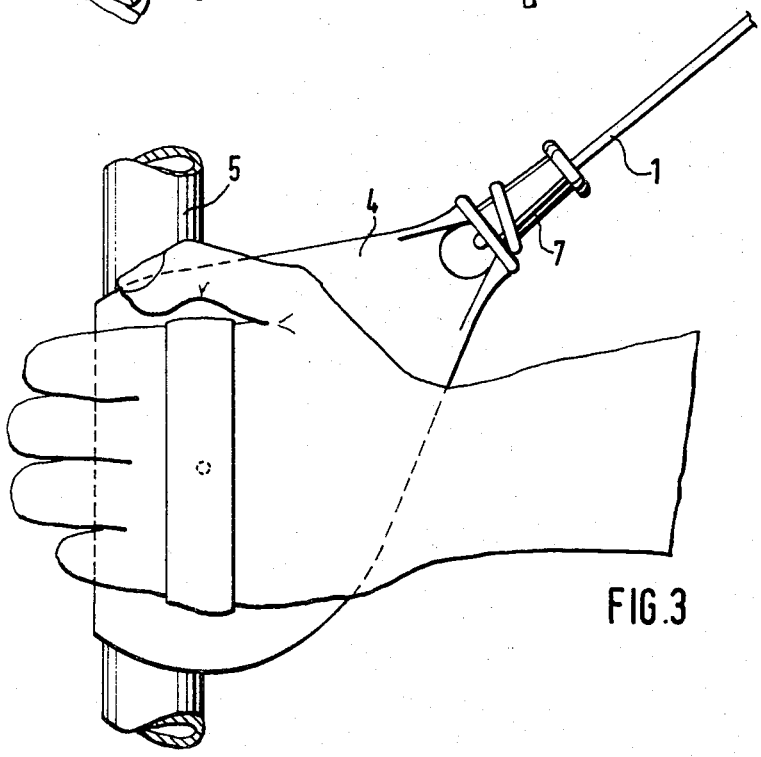
FIG. 3 is a plan view of the same.

As shown in FIGS. 2 and 3, the connecting element 4 can be formed, for example, as a rubber projection which is of one piece with an annular portion 7. The pulling element 1 which is in this case shown as a rope, extends through an inner passage of the portion 7. The end of the rope 1 is wound about the annular portion 7 for the fixing purposes. In order to perform a longitudinal adjustment, this fixation may be released and the operative length of the rope can be increased or reduced.

As can be seen from FIGS. 2 and 3, the holding loops 6 are mounted on the faces of the connecting elements 4 by means of rivets 8 and turnably about an axis which is normal to the above-mentioned faces. Thus, the user's hands are always located substantially normal to the longitudinal direction of the bar-shaped member 5 independently of the pulling direction of the pulling element 1, as shown in FIG. 3.

Figure 4:
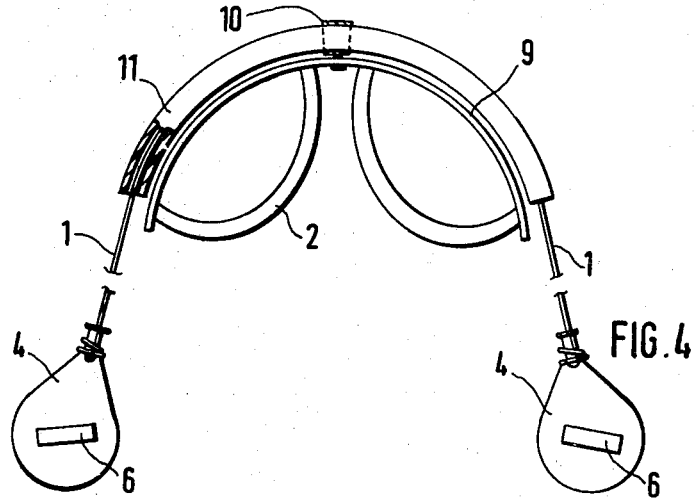
FIG. 4 is a simplified view showing the traction arrangement which includes a harness to be worn by the user.

FIG. 4 shows a harness to be worn by a user. An element 9 is provided in the harness 2 in the region of the user's back, approximately in the central back region. The element 9 has a holding member 10 which is turnable about a horizontal axis and carries a tubular member 11. The pulling element or rope 1 extends through the tubular member 11 and is guided by the latter in its longitudinal movement. Since the tubular member 11 is connected with the member 9 only in the central region, the ends of the tubular member 11 can move upwardly and downwardly so as to adjust to the pulling direction of the rope 1.

Since the connecting member 4 in this example is constituted by rubber, it has a high friction coefficient with the bar-shaped member 5 and also possesses resiliency in the longitudinal direction of the pulling element 1. Thereby, sudden loading resulting, for instance, from sudden flows is damped. Instead of, or additionally to this, the pulling element 1 may be also resilient, for instance, it may be constituted by a rubber rope or provided with special spring elements.

Figure 5:
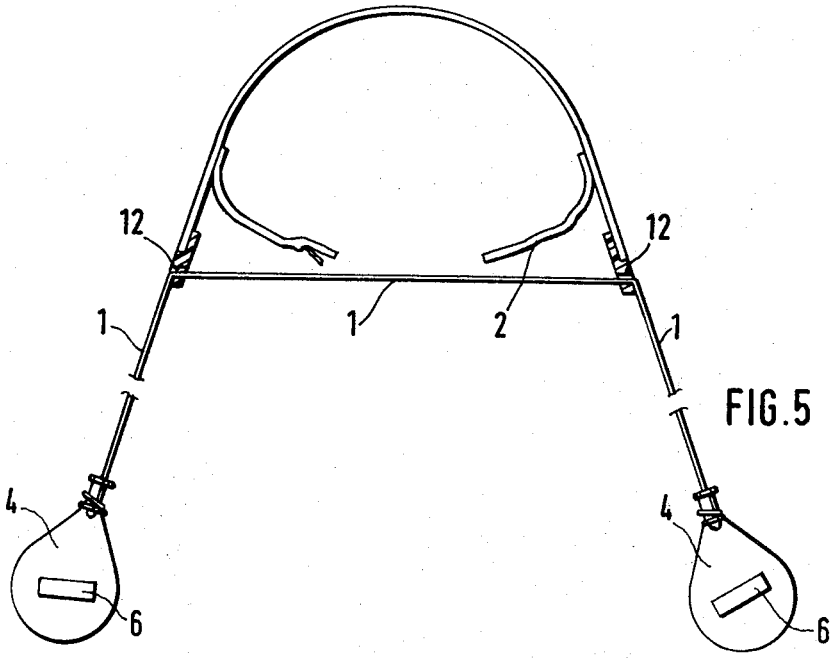
FIG. 5 is a view essentially corresponding to the view shown in FIG. 4 but showing another embodiment of the present invention.

FIG. 5 shows another embodiment of the present invention wherein the pulling element 1 extends through two ears 12 provided in the front region of the harness 2. Only one ear 12 may also be provided in the front region of the harness 2.

In order to transmit especially high pulling force when the pressure is very small, the faces of the bar-shaped member 5 and/or the connecting element 4 facing toward one another are constituted by roughened material with especially great coefficient of friction, for example by nubbed rubber. The connecting element 4 may be formed not as a separate member, but, instead, may be formed by the free end of the pulling element 1. Instead of the construction shown in the drawing wherein the pulling element 1 is an integral member, two separate pulling elements may be utilized, which separate pulling elements may be connected with the harness 2.

Figure 6:
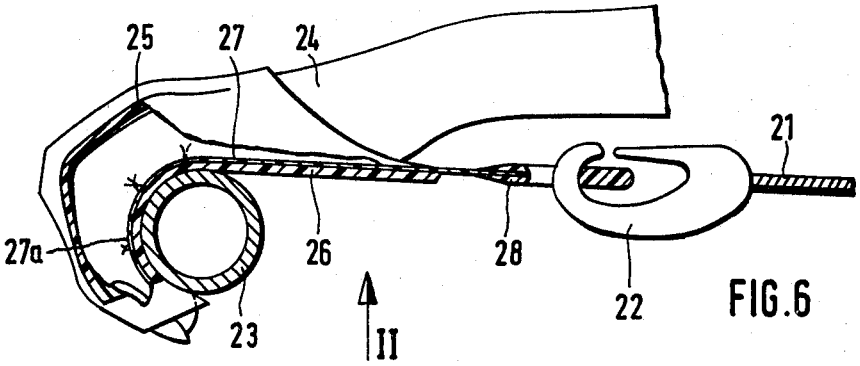
FIG. 6 is a longitudinal section of a connecting element which connects pulling elements of the traction arrangement to the bar-shaped member and is formed as a glove.

In the embodiment shown in FIG. 6, a rope 21 is provided with a hook 22 at each end thereof, such as an integral safety hook which is connected with the rope 21. The user's hand 24 which engages a bar-shaped member 23 extends into a glove 25 of rubber with curved fingers. The tips of the fingers are open. A reinforcing member 27 is located at a side of an inner face 26 of the glove which faces toward the hand 24. In this embodiment, the reinforcing member 27 is constituted by a texture of high-strength synthetic fibers.

The reinforcing member 27 is firmly connected with the inner face 26 of the glove. As shown in the drawing the glove 25 has only four fingers. The thumb of the user's hand remains outside of the glove. It is to be understood that the glove can be provided with five fingers so that the user's thumb is also located within the glove.

Figure 7:
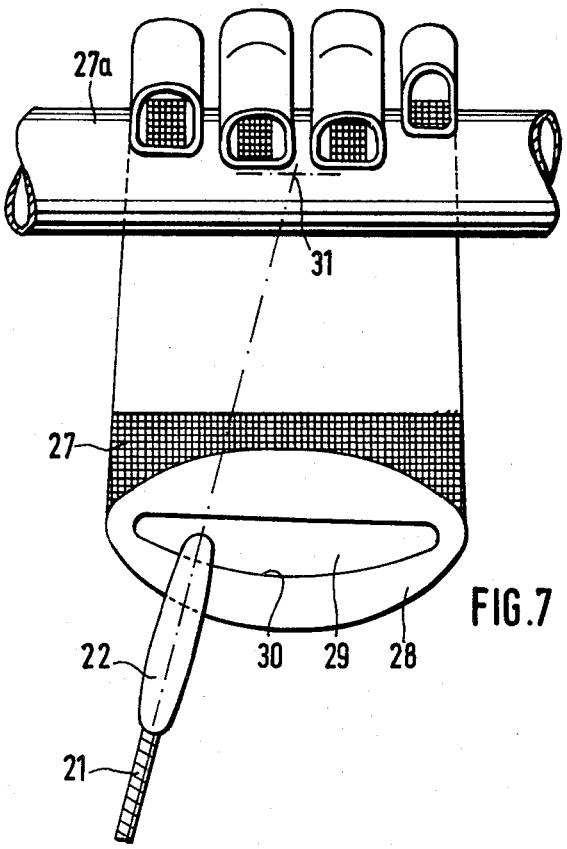
FIG. 7 is a plan view of the same taken in the direction of the arrow II in FIG. 6.

The free end of the reinforcing member 27 is provided with a mounting ear 28 which is constituted by polyamide and is produced by injection molding process. For instance, the ear 28 can be embedded into the reinforcing member 27 by injection so that suitable connection for transmission high pulling forces is attained. The ear 28 has an elongated mounting opening 29 which has an edge 30 engaged by the hook 22. The edge 30 is curved and has a center of curvature 31 which is located in the region of the bar-shaped member 22 engaged by the glove 25, as shown in FIG. 7. When the engagement position of the hook 22 varies as a result of different pulling directions of the rope 21, the force transmission point between the glove and the bar-shaped member does not vary so that the glove does not change its location.

The above-described glove is manufactured in the following manner. The reinforcing member 27 which has an injection molded ear 28 is positioned on a glove inner face of an immersion mold having curved fingers. Then, the immersion mold is immersed in a fluid, emulsified or dissolved glove material, such as rubber, for forming the glove as a coating of the mold. By this process, the reinforcing member 27 is homogeneously connected with the material of the glove inner face 26. In the present case, after a process of vulcanization the finger tips of the gloves 25 can be cut off so as to form holes which facilitate insertion of the user's hand into the glove and assures fast running off of water out of the glove.

The pulling element 1 or 21 and/or the guiding faces on which the pulling element slides during its longitudinal movement relative to the user'back, will be constituted by a material with especially good sliding characteristics in order to facilitate controlling movement performed by the bar-shaped member. It may be constituted, for instance, by polyamide, polytetrafluoroethylene or similar synthetic plastic materials.

The connection of the traction arrangement with the bar-shaped member is performed in a very simple manner and in a suitable position when the user embraces the bar-shaped member by her or his hands in conventional manner. The traction arrangement operates by insignificant movements of bent arms. The sail surfer is released by losing the bar-shaped member. Thereby, damages or injuries are eliminated.

Figure 8:
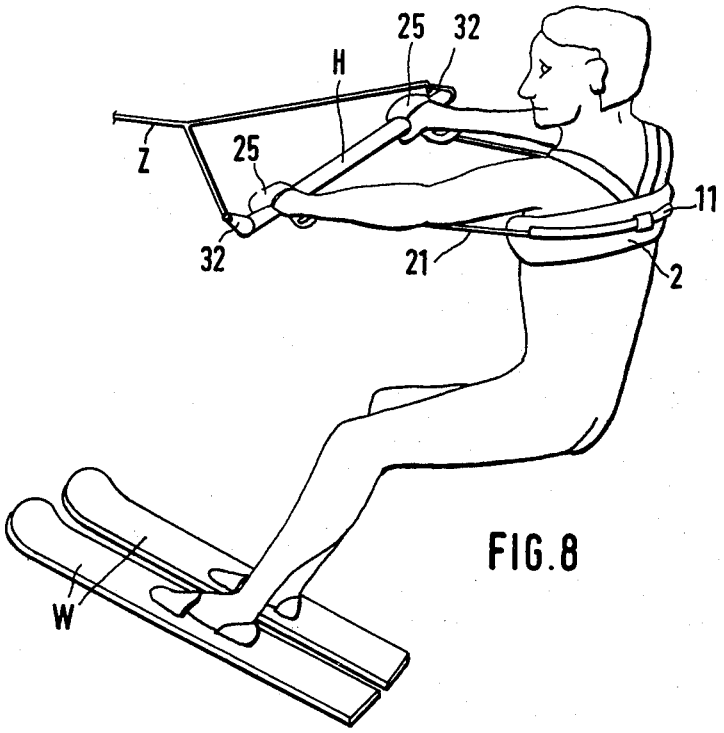
FIG. 8 is a view showing a water skier with the traction arrangement in accordance with the present invention.
Figure 9:
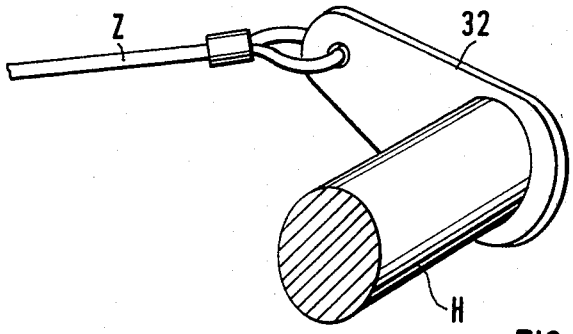
FIG. 9 is an enlarged fragmentary view of one end of the bar of the traction arrangement shown in FIG. 8.

FIG. 8 illustrates the utilization of the traction arrangement by a water skier. The rope 21 extends behind the water skier's back and extends through a tubular member 11 of the harness 2 worn by the user. The rope 21 is movable relative to the tubular member 11 in the longitudinal direction of the former. The both ends of the rope 21 extends to the water skier's hands and are connected with the gloves 25 having the above-described fingers. The glove 25 embraces a bar H which is connected with a rope Z. The latter is pulled by a not shown motor-boat. The water skier presses with his or her hands the inner portion 26 of the glove 25 about the bar H.

As shown in FIG. 8, the water skier holds his or her hands so that they are straight. The greater part of the force acting between the water skier's back and the bar H is transmitted by the rope 21. The water skier's hands and arms apply only such a force which assures application of a sufficient pressure deforming the glove 25 about the bar H. When the water skier loses the bar H, for instance in the case of fall, the force disappears and the traction arrangement becomes disconnected from the bar. No additional operations are needed for such a disconnection, which were necessary in the case of positive connections in the conventional arrangements.

Since the connecting elements 26, shown in FIG. 6, exerts a torque about the longitudinal axis resulting from the friction between the same and the bar H, it should be guaranteed that the bar H does not rotate about its longitudinal axis when the rope Z is tightened. For this purpose, arms 32 are non-rotatably mounted at the both ends of the bar H, and the rope Z engages the arms at a distance from the longitudal axis of the bar.

The harness to be worn by the user may be made as a girdle, slacks or may be used in connection with a kidney protector.

It will be understood that each of the elements described above, or two or more together, may also find a useful application in other types of constructions differing from the types described above.

While the invention has been illustrated and described as embodied in a traction arrangement for use by a sail surfer or water skier, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A traction arrangement for use by a sail surfer or water skier who is pulled along by holding onto a bar-shaped member connected to pulling means, comprising a harness arranged to be worn by a user and having a guiding element which is arranged to be located on the user's body; an elongated integral pulling element arranged to be worn by the user and movable in the direction of elongation thereof with guidance by said guiding element of said harness, said integral pulling element having two pulling portions which extend from the user's body toward the bar-shaped member and have leading ends spaced from one another; means for detachably connecting said pulling portions of said pulling element to the bar-shaped member and including two connecting elements each provided at the leading end of a respective one of said pulling portions, each of said connecting elements being flexible so as to be deformable about the bar-shaped member by a pressure of the user's hands and frictionally engageable with the bar-shaped member in deformed condition so that, in deformed condition, under the action of pressure of the user's hands and frictional engagement between said connecting elements and the bar-shaped member, said connecting elements are in frictional connection with the bar-shaped member and retained on the latter, whereas in the event of a fall or when the user wishes to disengage the bar-shaped member, cessation of pressure by the user's hands suffices to terminate the frictional connection.

2. The arrangement as defined in claim 1, each of said connecting elements is provided with means for fixing the same to the user's hand.

3. The arrangement as defined in claim 2, wherein each of said connecting elements has a face, said fixing means being turnable about an axis which is substantially normal to said face of a respective one of said connecting elements.

4. The arrangement as defined in claim 2 wherein said means includes a loop-shaped member through which the user's hand passes.

5. The arrangement as defined in claim 4, wherein each of said connecting elements has an outer surface facing away from the bar-shaped member, said loop-shaped member being arranged on said outer surface of a respective one of said connecting elements.

6. The arrangement as defined in claim 1, wherein each of said connecting elements has an inner surface which faces toward the bar-shaped member and is provided with means having high coefficient of friction with the bar-shaped member.

7. The arrangement as defined in claim 6, wherein said means includes a coating having a high coefficent of friction.

8. The arrangement as defined in claim 6, wherein each of said pulling portions forms a first member, and each of said connecting elements forms a second member, at least one of said members being constituted by a resilient material.

9. The arrangement as defined in claim 8, wherein the other of said members is constituted by a resilient material.

10. The arrangement as defined in claim 1, wherein each of said pulling portions forms a first member and each of said connecting elements forms a second member, at least one of said members being provided with spring means which is resilient in a pulling direction.

11. The arrangement as defined in claim 10, wherein the other of said members is provided with such spring resilient means.

12. The arrangement as defined in claim 1; and further comprising gloves each arranged on a respective one of said connecting elements.

13. The arrangement as defined in claim 1, wherein each of said connecting elements is deformable from an initial position to a final position in which latter it engages the bar-shaped member, each of said connecting elements being flat in said initial position thereof.

14. The arrangement as defined in claim 1, wherein said pulling portions are of one piece with one another and together form an integral pulling element.

15. The arrangement as defined in claim 1, wherein said harness includes a further element on which said guiding element is mounted turnably about a horizontal axis.

16. The arrangement as defined in claim 15, wherein said further element is arranged to be located approximately in a central region of the user's back so that said guiding element is turnably mounted in said central region.

17. The arrangement as defined in claim 16, wherein said guiding element is a tubular element having an inner passage, said integral pulling element extending through said inner passage and being movable therein in the direction of elongation of the former.

18. The arrangement as defined in claim 17, wherein said integral pulling element is a rope.

19. The arrangement as defined in claim 1, wherein said harness has parts which are in sliding contact with said integral pulling element, said guiding element being also in contact with said integral pulling element, said parts and said guiding element forming first contacting means and said integral pulling element forming second contacting means, at least one of said contacting means being constituted by a material having high sliding characteristics.

20. The arrangement as defined in claim 19, wherein the other of said contacting means is also constituted by a material having high sliding characteristics.

21. The arrangement as defined in claim 1, wherein each of said connecting elements is formed by said leading end of a respective one of said pulling portions of said pulling element.

22. The arrangement as defined in claim 1, and further comprising two gloves each arranged at a respective one of said pulling portions of said pulling elements and having an inner portion which forms a respective one of said connecting elements.

23. The arrangement as defined in claim 22, wherein each of said gloves has fingers with open finger tips.

24. The arrangement as defined in claim 22, wherein each of said gloves has fingers which are curved in an undeformed position.

25. The arrangement as defined in claim 22, wherein said inner portion of each of said gloves forming said connecting element is provided with a reinforcing member which is connected with a respective one of said pulling portions.

26. The arrangement as defined in claim 25, wherein each of said gloves has fingers, each of said reinforcing members having a strip-shaped projection extending into said fingers of a respective one of said gloves.

27. The arrangement as defined in claim 25, wherein said gloves are constituted by a rubber elastical material.

28. The arrangement as defined in claim 27, wherein said reinforcing members are constituted by a texture of high-strength synthetic fibers.

29. The arrangement as defined in claim 25, wherein each of said reinforcing members has a portion which projects outwardly beyond said glove; and further comprising ears each connecting said portion with the leading end of a respective one of said pulling portions of said pulling element.

30. The arrangement as defined in claim 29, wherein said ear is constituted by a synthetic plastic material, said portion of each of said reinforcing members being embedded in a respective one of said ears.

31. The arrangement as defined in claim 30, wherein said portion of each of said reinforcing members is constituted by polyamid, said portion of each of said reinforcing members being embedded into a respective one of said ears by an injection molding process.

32. The arrangement as defined in claim 29, wherein each of said ears has an inner hole having an inner edge with which said leading end of a respective one of said pulling portions of said pulling element engages, said inner edge being curved.

33. The arrangement as defined in claim 32, wherein said curved inner edge has a center of curvature which is located in the region in which the bar-shaped member is located, when the latter is engaged by said connecting element formed by said inner portion of a respective one of said gloves.

34. The arrangement as defined in claim 29, wherein the leading end of each of said pulling portions of integral pulling element is provided with a hook engaging in a respective one of said ears.

35. The arrangement as defined in claim 25, wherein each of said inner portions of said gloves has an inner surface facing toward a user's hand when the latter is inserted in said gloves, each of said reinforcing members being arranged on said inner surface and connected thereto.

36. The arrangement as defined in claim 35, wherein said bar has a longitudinal axis and is provided with at least one arm which is nonturnably connected to said bar, said rope being connected to said arm at a distance from said longitudinal axis of said bar.

37. The arrangement as defined in claim 36, wherein said bar has a central region, said arm being connected to said bar in said central region.

38. The arrangement as defined in claim 36, wherein said bar is provided with a second such arm connected to said bar, said rope being connected with both said arms.

39. The arrangement as defined in claim 38, wherein said bar has two spaced ends, each of said arms being arranged at a respective one of said ends.

* * * * *